United States Patent [19]

Habisohn

[11] 4,374,353

[45] Feb. 15, 1983

[54] MULTIPLE SPEED CONTROL MEANS FOR A VARIABLE SPEED MOTOR SYSTEM

[76] Inventor: Victor J. Habisohn, 1075 Englewood Rd., Hoffman Estates, Ill. 60195

[21] Appl. No.: 158,166

[22] Filed: Jun. 10, 1980

Related U.S. Application Data

[63] Continuation-in-part of Ser. No. 787,348, Apr. 14, 1977, Pat. No. 4,207,508.

[51] Int. Cl.[3] ..... H02P 5/40

[52] U.S. Cl. ..... 318/799; 318/305; 318/742

[58] Field of Search ..... 318/553, 554, 305, 740, 318/741, 742, 443, 799

[56] References Cited

U.S. PATENT DOCUMENTS

| | | | |
|---|---|---|---|
| 2,409,264 | 10/1946 | Feldhausen | 318/305 |
| 3,078,406 | 2/1963 | Zweifel et al. | 318/305 |
| 3,596,156 | 7/1971 | Davey | 318/741 |
| 3,772,579 | 11/1973 | Stone et al. | 318/742 |
| 3,943,420 | 3/1976 | Hind | 318/139 |
| 3,962,615 | 6/1976 | Spangler | 318/305 |

*Primary Examiner*—David Smith, Jr.
*Attorney, Agent, or Firm*—Jerome Goldberg

[57] ABSTRACT

A multiple speed control means for a variable speed motor system used for driving a hoist including multiple fixed speeds and a low speed range which is incrementally variable throughout the range. The control means provides distinct voltage levels which correspond to fixed motor speeds, the highest voltage corresponding to the maximum or full speed of the motor. Manual switch means switch into these fixed speeds or into the variable low speed range when the system is either in the hoist or lowering mode for respectively lifting or lowering a load in place.

A quick response circuit is connected into the system for a predetermined time duration after the system is switched into any of the speed positions except the maximum speed position.

4 Claims, 6 Drawing Figures

MULTIPLE SPEED CONTROL MEANS FOR A VARIABLE SPEED MOTOR SYSTEM

CONTINUATION-IN-PART

This patent application is a continuation-in-part of my patent application entitled "Variable Speed Motor Control System," Ser. No. 787,348 filed on Apr. 14, 1977, now U.S. Pat. No. 4,207,508.

BACKGROUND OF THE INVENTION

This invention relates generally to a control system for driving an alternating current (AC) motor and more specifically relates to a multiple speed control means for a variable speed motor system. Still more specifically, the invention relates to a variable speed motor control system for controlling the vertical movement of a hoist.

The speed of a squirrel cage induction motor is proportional to the power line frequency, number of poles. and the slip of the motor. The slip of the motor is directly related to the electrical energy applied to the input power terminals of the motor. The torque of the motor is proportional to the square of the voltage applied at the input to the motor. Thus, by varying the voltage magnitude per unit of time applied at the input power terminals, the torque and the speed of the motor can be varied. In the hoist control described herein solid state thyristors are inserted between the input power source and the input power terminals of the induction motor, and the voltage to the thyristors are phase controlled. The torque and speed of the motor is varied by varying the time duration of current flow per AC cycle from the source to the motor input power terminals.

In my said prior patent application entitled "Variable Speed Motor Control System," the speed of the motor was incrementally varied from zero to maximum speed. However, many applications for such variable speed systems required multiple fixed speeds for efficient operations. The subject patent application is directed to variable speed motor control systems for controlling a hoist and includes multiple speed levels, all of which being fixed speeds except the lowest speed level which is variable throughout a predetermined speed range.

It is contemplated that the principles and the various parts of the circuity of the subject invention are suitable and adaptable for use with other type systems, particularly those systems which require control of the speed of the motor, such as, for example, cranes, conveyors, pumps, fans etc.

SUMMARY OF THE INVENTION

The multiple speed control means of this invention includes a multiple position switch means which causes a specific voltage to be generated at each position of the switch means, corresponding to a selected speed for the motor means of the system. The speed switch in any of the speed positions maintains a contactor switch in a closed postion for connecting the AC voltage to the input of a solid state power switching network which transfers phase controlled power from a power source to the input of the motor means.

When switching from one position to another a quick response network is connected into the system for every position of the switch means except the maximum or full speed position, to bring the system quickly up to speed without feedback overshoot that may cause instability in the system.

BRIEF DESCRIPTION OF THE DRAWINGS

Referring to the drawings in which the same characters of reference are employed to indicate corresponding similar parts throughout the several figures of the drawings.

DESCRIPTION OF THE PREFERRED EMBODIMENT

Figure 1:
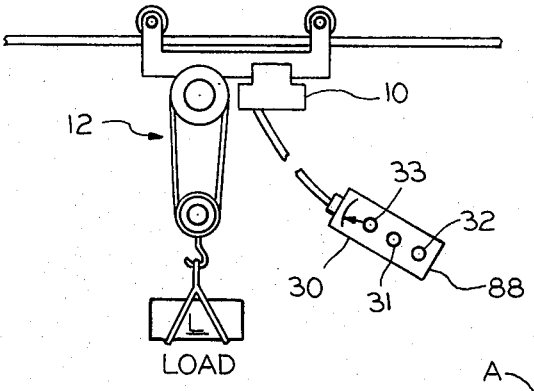
FIG. 1 illustrates a hoist for lifting and lowering a load which is part of an overhead trolley system.
Figure 2:
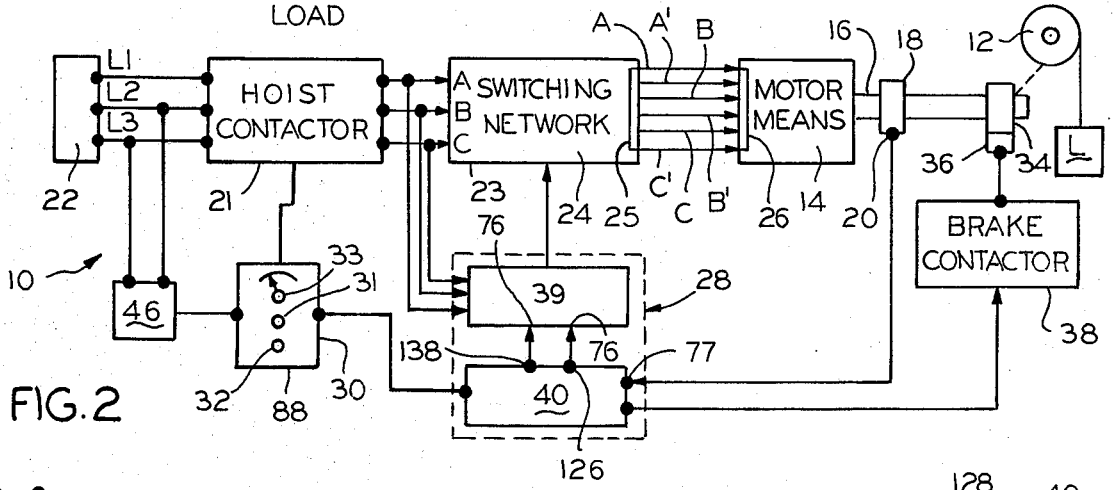
FIG. 2 is a block diagram of a variable speed motor control system for a hoist, embodying the principles of the invention.

Referring now to FIGS. 1 and 2 of the drawings, the reference numberal 10 indicates generally an adjustable speed A.C. motor control system suitable, for example, for driving a hoist 12 in a vertical direction. The control system 10 comprises a three phase motor means 14 driving a rotor 16. A tachometer 18 monitors the rotational speed of the rotor 16 and provides an electrical signal corresponding to the speed of the motor at the output 20.

A hoist contactor means 21 connects electrical power from an alternating current (AC) power source 22 to the input 23 of a static switching network 24. The output 25 of the static switching network 24 is connected to the input 26 of the motor means 14. An operational control means 28 controls the speed of the motor means 14 by varying the electrical energy transferred through the static switching network.

The hoist contactor 21 is a three position switch means having a hoist or lift position, a lowering position and an off-position. A manual control means 30 includes a depressible five position hoist switch 31, to switch the contactor 21 between the off-position and the hoist-position and also to provide five speed positions, four of the positions being fixed speeds and the remaining position being a variable low speed position adjustable over a predetermined range; and a depressible five position lowering switch 32, to switch the contactor 21 between the off-position and the lowering position and also to provide five speed positions, four of the positions being fixed speeds and the remaining position being a variable low speed position adjustable over a predetermined range. A variable resistor 33 is manually adjusted to control the low speeds of the hoist in either the hoist or lowering modes of operation for the hoist 12.

The static switching network 24 has a current conducting state and a current non-conducting state. The hoist contactor 21 connects voltage to the input 23 of the switching network 24 when the switching network 24 is in the non-conducting state. After voltage is connected to the switching network 24, the switching network 24 switch to the current conducting state.

A brake means 34 locks the rotor 16 of the motor 14 in a fixed position, when the hoist contactor 21 is off, or when the switching network 24 is in the non-conducting state and the hoist contactor 21 is either in the hoist-position or the lowering position. The brake means 34 includes a solenoid (not shown) which causes the rotor 16 to lock when de-energized, and unlocks or releases the rotor 16 upon being energized.

A brake contactor (not shown) controls the energizing and de-energizing of the solenoid. When the brake contactor is on, the solenoid is energized for de-activating the brake 34; and when the brake contactor is off, the solenoid is de-energized for activating the brake 34 and locking the rotor 16. The brake contactor 38 is switched on when the switching network 24 is switched to the current conducting state from the non-conducting state.

The operational control means 28 comprises a speed control circuit 40 (FIG. 2) for controlling and varying the vertical travel speed of the load, and a firing circuit 39 for switching on the static switching network 24 when the system is in the operational mode for hoisting or lowering the load L.

The switches 31 and 32 cause the solenoid coils 48H and 48L to energize for making the contactors of the hoist contactor 21, to connect the power source to the switching network 24, when in any of the speed positions.

SPEED CONTROL CIRCUIT

Figure 3:
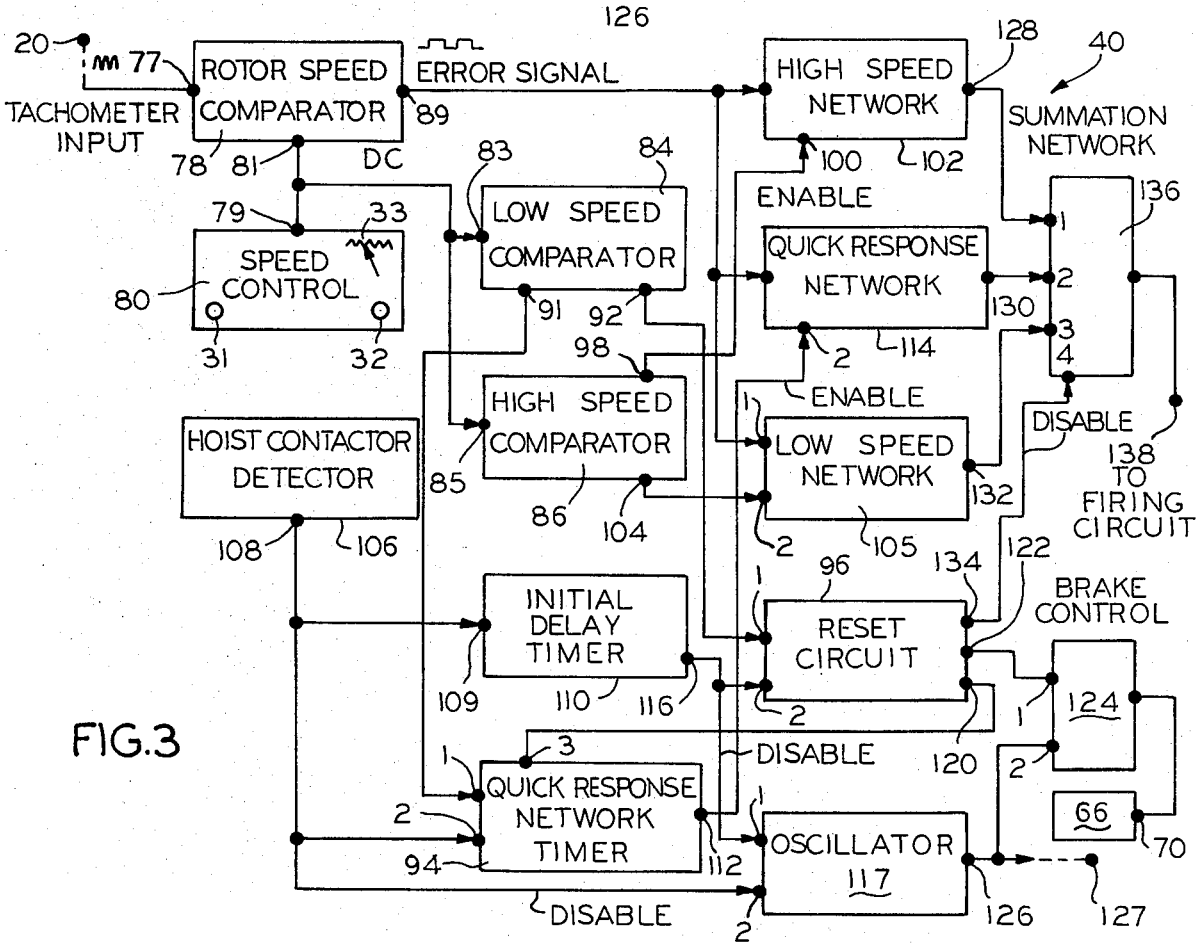
FIG. 3 is a block diagram of the speed control circuit.

Referring now more particularly to FIGS. 2, and 3, the speed control circuit 40 translates the electrical rotor speed signals received from the output 20 of the tachometer 18, to electrical time varying signals for coupling to the input of the firing circuit.

The electricl rotor speed signals from the tachometer 18 are coupled to the input 77 of a rotor speed comparator 78. The output 79 of the speed control means 80 is tied to the input 81 to the rotor speed comparator 78, to the input 83 of the low speed comparator 84, and also to the input 85 of the high speed comparator 86.

The manual speed control means includes five speed levels between a low speed level and a maximum or full speed level. The speed is adjustable within the low speed level with variable resistor 33. If the resistor 33 is adjusted lower than the minimum speed level for the system, the static switching network 24 is turned off, and the electrical power connection is severed from the input 26 of the motor means 14 and also the brake coil is de-energized to lock the rotor 16.

The low speed comparator 84 includes an output 91 and an output 92. The output 91 is tied to input 1 to a quick response network timer 94, and the output 92 is tied to the input 1 to a reset circuit 96.

The high speed comparator 86 includes an output 98, which is tied to input 100 of a high speed response network 102 and an output 104 which is tied to input 2 of a low speed response network 105. When the system 10 is in the high speed mode, output 98 provides an enable signal at the input 100 to the high speed network 102, and the output 104 provides a disable signal for coupling to the input 2 to the low speed network 105; and, when the system 10 is in the low speed mode the enable signal at the output 98 is removed and an enable signal appears at the output 104, for coupling to the input 2 of the low speed network 105.

An AC contactor detector 106 detects the de-energizing of the hoist contactor coils (not shown). The output of the contactor detector is connected to input 109 of the initial delay timer 110, to input 2 of the quick response timer 94, and input 2 of an oscillator 117. The output 112 of the quick response network 124. The output 116 of the initial delay timer 110 is tied to input 1 of the oscillator 117 and also to input 2 of the reset circuit 86.

The output 120 of the reset circuit 96 is connected to input 2 of the quick response timer 94 and output 122 of the reset circuit 96 is connected to input 1 of a brake control 124. The output 126 of oscillator 117 is tied to input 2 to the brake control 124 and to input 127 to the firing circuit 39.

The output 128 of the high speed network 102, the output 130 of the quick response network 114, the output 132 of the low speed response network 105, the output 134 of the reset circuit 86 are connected respectively to inputs 1,2,3, and 4 to a summation network 136 is coupled to input 76 to the firing circuit 39.

The speed of the motor 14 is determined by the position of the depressible switches 31,32 and the setting of the adjustible resistor 33 when the switches 31 and 32 are in the low speed position. The output 79 of the speed control 80 is a direct current (DC) voltage which is compared with the tachometer signal at input 77 to the speed comparator 78. The output 89 of the speed comparator 78 is an error signal which is tied to the quick response network 114, the high speed network 102 and to the low speed network 105. The tachometer signal varies in voltage and frequency.

The low speed comparator 84 is preset to a low DC level corresponding to the lowest speed the system 10 can effectively operate, and compares such low speed level with the speed signal voltage at the output of the manual speed control 80. The low speed comparator 84 is normally in an off-mode and switches to an on-mode when the manual DC level exceeds the preset low DC level.

When the low speed comparator switch 84 is in the on-mode, the output 91 applies an enable signal to the input 1 of the quick response timer 94 to switch the timer 94 on, and the output 92 does not inhibit the reset circuit 96, which switches from the reset to the off-condition. When the low speed comparator switch 84 is in the off-mode, the enable signal at the output 91 is removed, and the output 92 applies a disable signal to the input 1 to the reset circuit 96 tp switch it into the reset-condition.

When the high speed comparator 86 is in the on-mode the output 98 applies an enable signal to the input 100 to the high speed network 102, and output 104 applies a disable signal to the input 2 to the low speed network 105. When the high speed comparator switch 86 is in the off-mode, the enable signal at the input 100 to the high speed network 102 is removed, and the output 104 applies an enable signal to the input 2 to the low speed network 105.

When the initial delay timer 110 is on, a disable signal is applied to the oscillator 117 and to the reset circuit 96, to maintain the oscillator 117 off and the reset circuit 96 in the reset-condition during time t0 to a time t1. When the delay timer 110 is off the disable signal at output 116 is removed.

When the quick response timer 94 is on, an enable signal is applied to input 2 to the quick response network 114, which is removed when the quick response timer 94 is off.

When the low speed comparator 84 is in the off-mode, the reset circuit 96 is in the on or reset-condition to prevent the brake solenoid 36 from energizing to maintain the brake 34 in a locked-condition for locking the load in place.

If the low speed comparator 84 is switched from the on-mode to the off-mode when the manual speed control 80 is turned to a zero or no speed-position, the reset circuit 96 is switched from an off-condition to the reset-condition to de-energize the brake solenoid 36 causing the brake 34 to lock the load, and also to reset the quick response timer 94.

When the low speed comparator 84 is switched back to the on-mode from the off-mode, an enable signal is connected from the output 91 to the input of the quick response timer 94, to generate an output enable signal for turning on the quick response network 114, and the disable signal is removed from the output 92 thereof to cause the reset circuit 36 to switch from the reset to the off-condition if the initial delay timer 110 is not on.

When the reset circuit 96 is in the reset-condition, the output 120 has a reset signal which is applied to the quick response timer 94, the output 122 applies a disable signal to the brake control 124 to cause the brake 34 to move to the lock-position and the output 134 applies a disable signal to the summation network 136. When the reset circuit 96 is in the off-condition, the reset signal to the quick response time 94 and the disable signals to the summation network 136 and to the brake control 124 are removed. The brake 34 is released, the summation network is operative for controlling the firing of the thyristors of the static switching network, and the quick response timer starts counting from the same start point.

The hoist contactor detector 106 detects the de-energizing of the hoist contactor coils before the contacts open, and generates a break/disable signal at the output 108, when the hoist contactor 21 is switched from an on to an off-position. The break/disable signal causes the oscillator 117 to turn off, resets the initial delay timer 110 and also resets the quick response timer 94 before the contacts actually open. Thus, even when the operator of the hoist is plugging or inching the load by instantanious switching of the hoist contactor 21 on and off, the timers always start from the initial start point. Moreover, by turning off the oscillator 117 to prevent firing of the thyristor switches for severing the electrical connection between the electrical source 22 and the motor 14, arcing across the switch is prevented when the contactor switches break from the closed to the open position.

SPEED CONTROL MEANS

Figure 4:
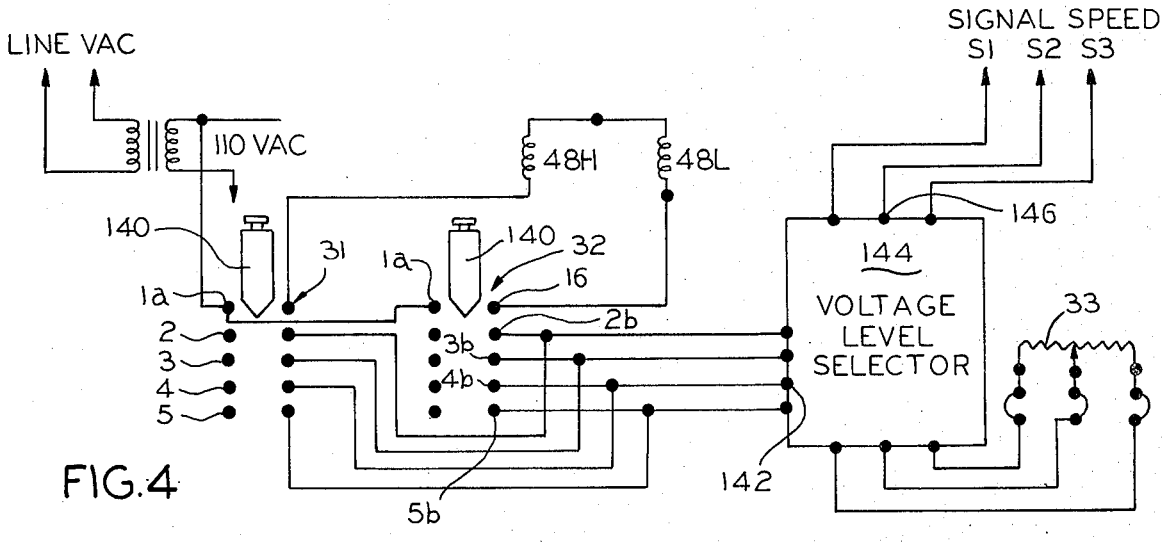
FIG. 4 is a schematic and block diagram of the speed control means, for adjusting the speed of the system.
Figure 5:
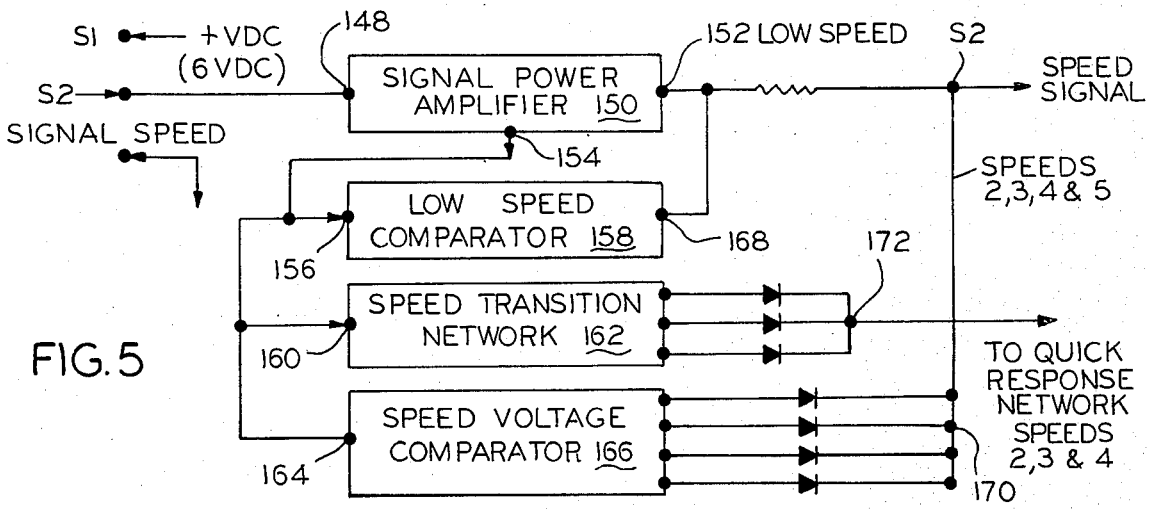
FIG. 5 is a diagram of the speed control means after the motor speed has been selected.

Referring now specifically to FIG. 4, the speed control means 80 will be described with greater detail. The hoist/up switch 31 and the lowering switch 32 each includes a contact plunger 140 which is depressed inward upon the application of inward pressure usually from the operator's thumb against the resilient force of a spring, and the plunger 140 is resiliently returned to a normal outward position when the thumb releases its force from the button or head of the plunger 140.

The AC common line voltage is connected to contact 1*a* of switches 31 and 32, and upon the plunger 140 stopping at speed position 1*a* or moving through position 1 to a different speed position, the AC line voltage is connected to the line contactor solenoid 48H or 48L corresponding to the speed switch 31 or 32 being manually activated. After the hoist contactors 21 close and the static switching network 24 starts conducting, logic voltage is impressed into the system 10. If the plunger 140 is in position 1, the low speed position, the resistor 33 may be varied to precisely set or control the low speed for the hoist 12, Positions 2, 3, 4, and 5 each represents a fixed speed and the action of the variable resistor 33 is inhibited. The speed setting is greater for each increased numeral with position 5 being the maximum or full speed of the system. For example, the variable speed range for position No. 1 may be approximately 20 to 1 to 8 to 1 of the full speed of the motor; speed position No. 2 may be 6 to 1; speed position No. 3 may be 3 to 1; speed position No. 4 may be 2 to 1; and speed position No. 5 may be full speed.

Speed positions 2, 3, 4, and 5 are connected to the input 142 of a voltage level selector means indicated generally by the reference numeral 144, which generates the voltage signal corresponding to the selected motor speed.

The voltage speed signal from the output 146 of the voltage level selector means 144 is connected via line S2 to the input 148 of a signal power amplifier 150 (buffer amplifier). If either switch 31 or 32 is in the low speed position (No. 1), the low speed signal will appear at the output 152 of the power amplifier 150 and pass to the output 79 of the speed control means 80 for coupling to the rotor speed comparator 78 to set the motor speed.

An output signal is connected from the output 154 of the power amplifier 150 to the input 156 of the low speed comparator 158, to the input 160 of the speed transition comparator 162 and to the input 164 of the speed voltage level comparator 166. If either switch 31 or 32 is in the higher speed positions No. 2, 3, 4 or 5, the output 168 of the low speed comparator 158 will generate an inhibit signal for connecting to the output 152 of the power amplifier 150, and thereby prevent the low speed signal from the variable resistor 33 from appearing at the output 152. When the inhibit signal is impressed the speed signal S2 will be derived from the DC signals corresponding to the fixed speed positions at point 170, the output of the speed voltage comparator 166.

When the low speed signal at the output 152 is inhibited, speed signals corresponding to speeds 2,3 and 4 will provide a signal at the output 172 of the speed transition network 162, to activate the quick response network to bring the system quickly up to the selected fixed speed. For the selected full speed of the motor, switch position No. 5 of switches 31 and 32, the quick response network need not be activated, since the system automatically seeks to reach full speed.

Speed signals corresponding to positions 2,3,4 and 5 of switches 31 and 32 appear at the output 170 of the speed voltage comparator, which passes to the output 79 of the speed control means 80, and also provides the signal for driving the firing circuit, which determines the time durations that the SCRs of the static switching network are on to generate the selected speed for the motor.

Figure 6:
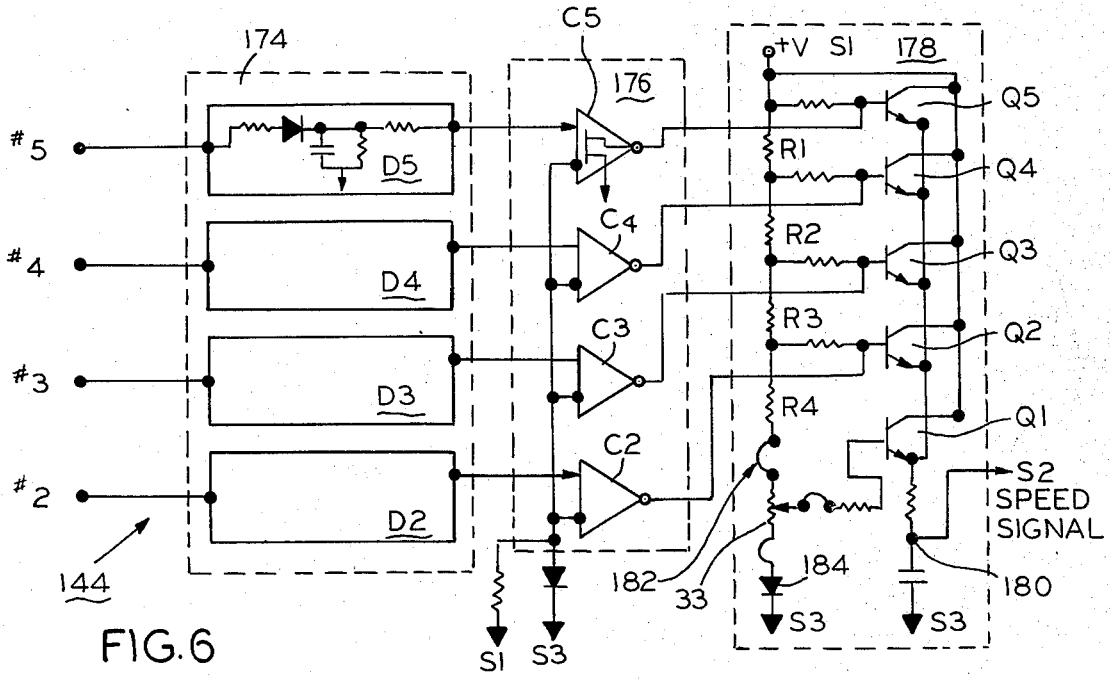
FIG. 6 is a block diagram of the speed voltage level generator.

Referring now to FIG. 6 of the drawings, the voltage level selector 144 includes detector means 174 comprising detectors D2,D3,D4 and D5, which converts the A.C. line voltage to a DC speed signal, for activating the comparator switches 176 including switches C5,C4,C3 and C2. The comparator switches activate the voltage ladder or summing means indicated generally by the reference numeral 178 which includes emitter followers Q5,Q4,Q3, Q2 and Q1, to provide the DC speed signal at output point 180 which corresponds to the selected speed If, for example, speed position No. 4 is selected, the AC line voltage signal is detected via Q4 of the detector means 174; the comparator switch C4 of the comparator means 176 is switched on, to activate the emitter follower Q4, to generate the DC voltage at output point 180 corresponding to the voltage from the resistive ladder 182 formed from the resistors, R1,R2,R3, R4, and variable resistor 33 and the voltage drop of diode 184. The DC signal voltage corresponding to the selected speed appears at point 180. If the low speed for variable precise control is selected, the voltage level selector 144 is off or inhibited, and the speed signal S2 which is impressed at the input 148 to the power signal amplifier 150, is derived from the setting of the variable resistor 33, the voltage therefrom being transferred through the emitter follower Q1 to point 180.

The description of the preferred embodiments of this invention is intended merely as illustrative of the subject invention, the scope and limits of which are set forth in the following claims.

I claim:

1. A hoist control system for moving a load from one position to another position, comprising:

an alternating current ("AC") power source;

a motor means for driving said load;

a static switching network having an input and an output, the output of said network being connected to the motor means;

a power switch means interposed between the AC power source and the input of the static switching network for connecting the AC power source thereto;

a mechanical switch member having a plurality of fixed positions and a variable low speed position;

a voltage level selector means including means for detecting AC voltage and converting to a DC signal corresponding to the selected fixed speed of the motor and including means for providing variable DC signals corresponding to incremental variations of the low speed of the motor, said voltage level selector means providing said fixed speed signal when the switch means is in any one of said fixed positions and providing said DC signal corresponding to said incremental variations when said switch member is in the variable low speed position, and said voltage selector being inhibited from providing said low speed DC signals when the switch member is in any of said fixed positions.

2. The speed selector means of claim 1 includes a signal power amplifier for receiving speed signals corresponding to the selected speed; and a low speed comparator switch receiving an input signal from said power amplifier, said low speed comparator providing said inhibit signal in response to said input signal corresponding to speed signals other than those signals generated from the variations of the low speed.

3. The system of claim 2 includes a quick response network to quickly bring the system up to the selected speed, said quick response network being activated with the system moves from an off condition to a low speed condition, said quick response network being activated when the system is witched from a low speed to a higher speed, except when the system is switched from a lower speed to a full speed of the motor.

4. The system of claim 3 includes:

a speed voltage comparator having an input from said signal power amplifier, to provide an output signal corresponding to a selected fixed speed for the motor.

* * * * *